US005564245A

United States Patent [19]

Rademacher

[11] Patent Number: 5,564,245

[45] Date of Patent: Oct. 15, 1996

[54] HANGERS FOR SIDING

[76] Inventor: Richard J. Rademacher, 6800 Queensberry Dr., Charlotte, N.C. 28645

[21] Appl. No.: 245,421

[22] Filed: May 18, 1994

[51] Int. Cl.[6] ..... E04D 1/00

[52] U.S. Cl. ..... 52/520; 52/549; 52/547

[58] Field of Search ..... 52/543, 546, 547, 52/549, 520, 552, 553, 551

[56] References Cited

U.S. PATENT DOCUMENTS

| | | | |
|---|---|---|---|
| 1,593,408 | 7/1926 | Honigbaum . | |
| 1,651,392 | 12/1927 | Honigbaum . | |
| 2,511,083 | 6/1950 | Small | 52/547 |
| 2,535,620 | 12/1950 | Alvarez | 103/17 |
| 2,648,103 | 8/1953 | Wahfeld | 52/546 X |
| 2,659,323 | 11/1953 | Alvarez, Jr. | 52/546 X |
| 3,173,229 | 3/1965 | Weber | 52/549 X |
| 3,738,076 | 6/1973 | Kessler | 52/547 |
| 3,818,668 | 6/1974 | Charniga | 52/547 |
| 4,054,012 | 10/1977 | Paradisi | 52/544 |
| 4,079,562 | 3/1978 | Englert | 52/545 |
| 4,089,141 | 5/1978 | Heroux | 52/105 |
| 4,314,426 | 2/1982 | Casteel | 52/127 |
| 4,435,933 | 3/1984 | Krowl | 52/309.1 |
| 4,698,942 | 10/1987 | Swartz | 52/99 |
| 5,274,978 | 1/1994 | Perkonigg et al. | 52/547 |
| 5,392,579 | 2/1995 | Champagne | 52/546 X |

FOREIGN PATENT DOCUMENTS

| | | | |
|---|---|---|---|
| 1709312 | 2/1973 | Germany | 52/547 |
| 158167 | 1/1933 | Switzerland | 52/547 |

*Primary Examiner*—Lanna Mai

*Attorney, Agent, or Firm*—Ralph H. Dougherty; Scott E. Hanf

[57] ABSTRACT

An apparatus for installing a floating siding wall of lap siding on vertical studs, including a series of specially formed siding locator-retainer members which are fastened to the studs with the siding members situated therein, the siding members not being fastened to the studs directly; and the resulting siding wall.

13 Claims, 4 Drawing Sheets

HANGERS FOR SIDING

FIELD OF THE INVENTION

The present invention relates to a method and apparatus for installing lap siding, and more particularly to hardware configured to facilitate hanging of siding onto a structure, as well as a siding wall structure.

BACKGROUND OF THE INVENTION

Builders have long sought a way to hang a floating wall, one in which each siding board is not fastened to the next one. In addition, currently available pressed board siding is extremely hard and dense, and thus very resistant to nails being driven through it.

The present invention allows a builder to hang pressed particle board as exterior siding from the studs on a house without driving nails through the hard pressed particle board, as well as a means for hanging a floating wall.

Metal siding frequently is dented when a nail is driven through it, creating an unsightly condition and reducing the value of the building. Regular wood siding is also subject to denting.

DESCRIPTION OF THE PRIOR ART

Applicant is aware of the following U. S. Patents concerning siding clips, retainers, and holders:

| U.S. Pat. No. | Issue Date | Inventor | Title |
|---|---|---|---|
| 1,593,408 | 07-20-1926 | Honigbaum | RETAINER FOR COMPOSITION ROOFING |
| 1,651,392 | 12-06-1927 | Honigbaum | RETAINER |
| 2,535,620 | 12-26-1950 | Alvarez, Jr. | METAL SHINGLE AND STRIP |
| 3,738,076 | 06-12-1973 | Kessler | NAILING CLIP FOR PLASTIC SIDING |
| 3,818,668 | 06-25-1974 | Charniga | SIDING MOUNTING STRIP |
| 4,054,012 | 10-18-1977 | Paradisi et al. | STARTER STRIP FOR METAL SIDING |
| 4,079,562 | 03-21-1978 | Englert et al. | SIDING STARTER CLIP FOR SECURING TO THE SIDE OF A STRUCTURE AND ENGAGING A SIDING STARTER PANEL |
| 4,089,141 | 05-16-1978 | Heroux | APPLICATION OF SIDING, SHINGLES OR SHAKES TO A WALL STRUCTURE |
| 4,314,429 | 02-19-1982 | Casteel et al. | SIDING HOLDER |
| 4,435,933 | 03-13-1984 | Krowl | VINYL SIDING ATTACHMENT |
| 4,698,942 | 10-13-1987 | Swartz | CLIP FOR HOLDING AND SPACING SIDING PANELS |

Honigbaum U.S. Pat. No. 1,593,408 provides a retainer for composition roofing, which has a J-portion similar to applicant's J-hook.

Honigbaum U.S. Pat. No. 1,651,392 provides a retainer device for hanging various items on walls as well as for securing composition shingles to a roof.

Alvarez, Jr. U.S. Pat. No. 2,535,620 teaches an improved method of applying shingles to a wall, where the walls are constructed of particularly flimsy material. This invention provides a shingle supporting strip which is made of elongated metal and supports the lower and upper ends of the shingles so that the shingles can be attached much quicker.

Kessler U.S. Pat. No. 3,738,076 provides small nailing clips of a special construction which are economical and allows the siding to be nailed into a wall loosely to permit thermal expansion and contraction.

Charniga U.S. Pat. No. 3,818,668 provides a siding mounting strip which can support the lower edge of the next applied siding board and allows a longitudinal cushion between the siding board and the wall surface. However, it requires nailing directly through the siding board.

Paradisi et al. U.S. Pat. No. 4,054,012 provides a starter strip and siding strip to attach to a wall, having a hooked lower edge. The hooked lower edge can be engaged with the flanges in a horizontal position so that the strip floats freely. Then the siding strip is rotated into a vertical position without disengagement from the starter strip and nailed into place, which allows for daily and seasonal temperature changes. It appears that this patent is concerned with metal siding only.

Englert et al. U.S. Pat. No. 4,079,562 provides a siding starter clip which can be attached to a wall, comprised of sheet metal and having three extended nailing leg portions, for strengthened support for a siding starter panel.

Heroux U.S. Pat. No. 4,089,141 provides a tool to assist in the application of siding boards, shingles, shakes, or the like to a wall. The tool can be withdrawn after each use..

Casteel et al. U.S. Pat. No. 4,314,429 provides a device to support one end of a lap siding member while the other end is being attached to a wall manually. It fits under an upper siding board and over a lower siding board. However, there is no suggestion of fastening it to a stud.

Krowl U.S. Pat. No. 4,435,933 provides permanent clips which grip the top edge of extruded vinyl siding on a wall and allows for seasonal temperature changes.

Swartz U.S. Pat. No. 4,698,942 teaches a method for holding one end of siding while the other end is being installed. The invention can be removed after installation of the first end of the siding and be used to install the remaining loose end of siding. Also, the invention allows for seasonal temperature changes.

SUMMARY OF THE INVENTION

The invention provides apparatus for hanging what is termed in the industry as a "floating wall".

This invention also allows a builder to hang pressed particle board as exterior siding from the studs on a house without driving nails through the hard pressed particle board.

The invention comprehends three types of siding clip, or siding locator-retainers. J-clips are used to locate the bottom piece of siding. The clips are attached to vertically positioned studs with nails so that the siding piece may be set in the recesses in the J-clips. Then a second type clip is fitted over the top of the siding piece and nailed to the stud. The second type clip has a second recess for supporting a second, upper siding piece. At the top of the wall structure, a third type clip is provided to engage the top of the uppermost siding piece, and is nailed to the stud. Soffit and fascia are installed to cover the uppermost clip.

OBJECTS OF THE INVENTION

The principal object of the invention is to provide an improved means for hanging a floating wall of siding material on a building such as a house.

Another object of the invention is to provide siding hangers for attaching siding to studs without the necessity of nailing to or through siding or adjacent pieces of siding.

A further object of this invention is to provide an improved method for installing lap siding on a house or other building.

BRIEF DESCRIPTION OF THE DRAWINGS

The foregoing and other objects will become more readily apparent by referring to the following detailed description and the appended drawings in which.

DETAILED DESCRIPTION

Figure 1:
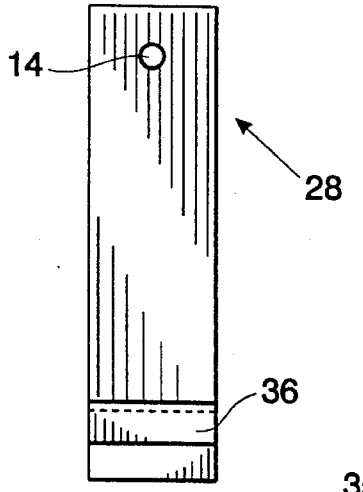
FIG. 1 is a front view of the uppermost siding locator-retainer or clip in accordance with the invention.
Figure 2:
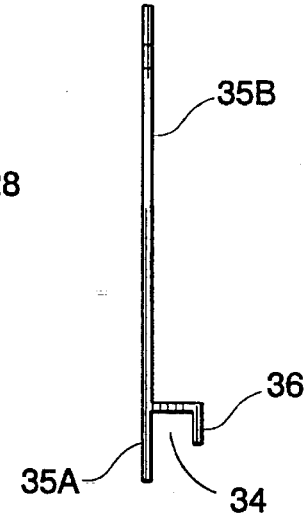
FIG. 2 is a left side view of the siding locator-retainer or clip of FIG. 1.
Figure 3:
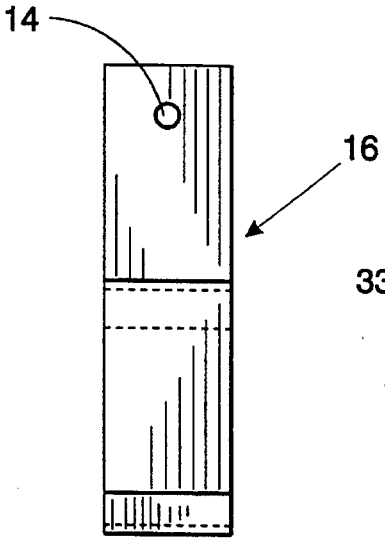
FIG. 3 is a front view of an intermediate siding locator-retainer or clip according to the invention.
Figure 4:
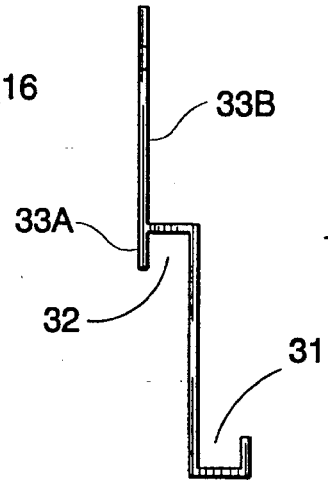
FIG. 4 is a left side view of the intermediate siding locator-retainer or clip of FIG. 3.
Figure 5:
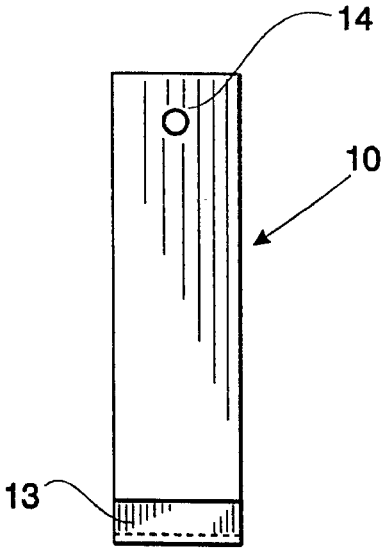
FIG. 5 is a front side view of a lower siding locator-retainer or clip in accordance with the invention.
Figure 6:
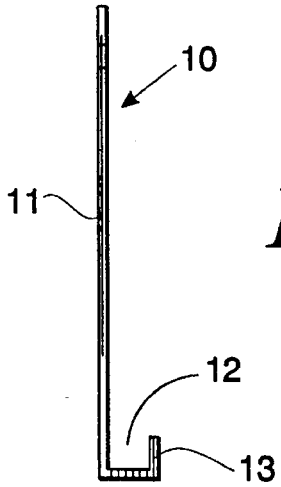
FIG. 6 is a left Side view of the lower siding locator-retainer of FIG. 5.
Figure 8:
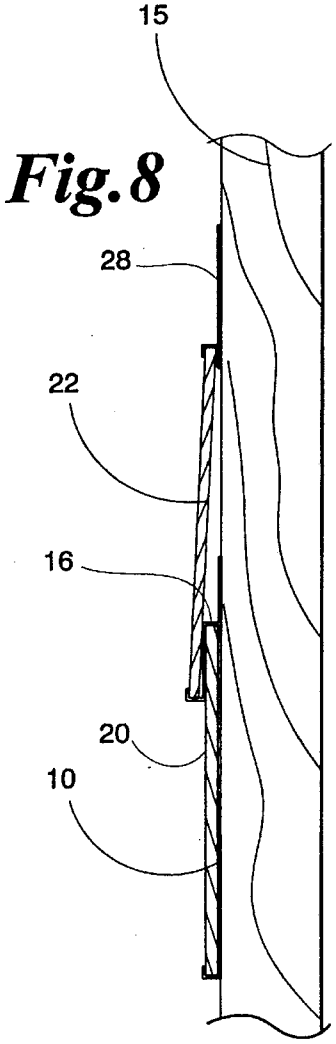
FIG. 8 is a sectional view taken through the siding members adjacent the studs of FIG. 7 taken along line 8—8 of FIG. 7.
Figure 7:
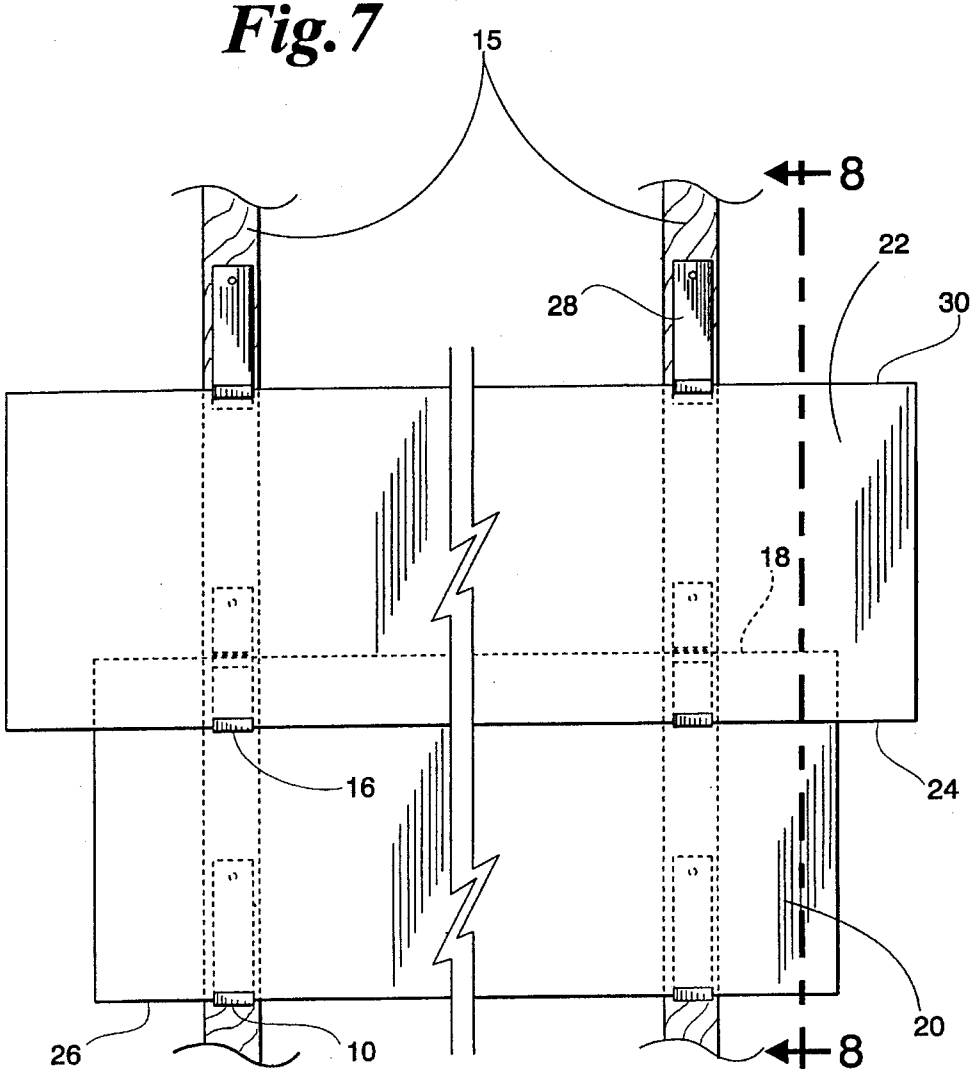
FIG. 7 is an elevational view of a siding wall in accordance with the invention, but with insulation omitted for clarity.
Figure 11:
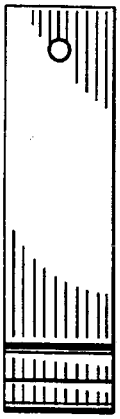
FIG. 11 is a front view of an alternative upper siding locator-retainer made of formed or bent sheet material.
Figure 12:
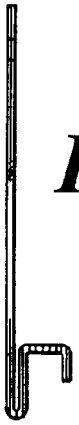
FIG. 12 is a left side view of the alternative upper siding locator-retainer made of formed or bent sheet material, according to FIG. 11.

Referring now to the drawings, and particularly to FIGS. 7 and 8, the invented siding hanging system includes: J-shaped lower siding locator-retainer members 10, having a lower recess 12, formed by a retaining flange 13 and preferably having an upper nail hole 14 in nailing strip 11, for attachment to studs 15; intermediate siding locator-retainer members 16 for engaging the upper edge 18 of a first siding member 20, and for locating and retaining a next higher siding member 22 with its lower edge in parallel alignment and parallel alignment with the lower edge 26 of first siding member 20; and a series of upper locator-retainer members 28 for attachment to studs 15 and engaging the upper edge 30 of the upper siding member 22.

The intermediate siding clip 16 has a lower upwardly-opening recess 31 and a higher downwardly-opening recess 32 on its reverse partially formed by a downwardly extending rear flange 33A, and has a nailing strip 33B extending upwardly from and in alignment with the rear flange 33A.

The upper locator-retainers have a downwardly-opening recess 34 at their lower end by downwardly extending flange 35A from nailing strip 35B and spaced flange 36.

Preferably all of the siding clips have upper central nail holes 14 so the installer does not have to contend with nailing through tough material.

The locator and retainer members 10, 16 and 28 are preferably made of a light gauge tough plastic material, and can be clear or have an integral color. Suitable plastic material can be selected from the group consisting of polypropylene (PP), polyethylene (PE), ultra high molecular weight polyethylene (UHMWPE), ethylene chlorotrifluoroethylene (ECTFE), ethylene tetrafluoroethylene (ETFE), polyvinylidene fluoride (PVDF), chlorotrifluoroethylene (CTFE), fluorinated ethylene propylene (FEP), perfluoroalkoxy (PFA), acrylonitrile-butadiene-styrene (ABS), chlorinated polyvinylchloride (CPVC), fiberglass reinforced polypropylene, fiberglass reinforced vinyl ester, fiberglass reinforced epoxy, polyphenylene sulfide (PPS), polyphthalamide (PPA), fiberglass reinforced polyvinylchloride, and polysulfone.

In operation, a wall structure according to the invention is constructed on a series of spaced upright studs 15. A multiplicity of "j" shaped lower siding locator-retainer members 10 are fastened to the studs with their lower recesses 12 aligned to hold a siding member 20 with its lower edge 26 level. An elongated siding member 20 is positioned in the lower "J" retainers 10, then a series of intermediate siding locator-retainer members 14 are installed on the upper edge 18 of the first siding member 20, and nailed into position on the studs 15. The upward-opening recess 31 receives and retains a next higher siding member 22 with its lower edge 24 in parallel alignment with the lower edge 26 of the first siding member. As many siding members as desired are installed using intermediate siding clips 16. When the uppermost siding member has been positioned, a series of upper locator and retainer members 28 are attached to the studs 15, engaging the upper edge 30 of the uppermost siding member. Soffit and fascia is then installed which covers upper retainer members 28.

ALTERNATIVE EMBODIMENTS

Figure 9:
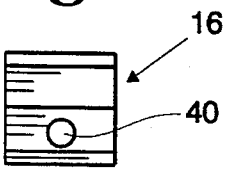
FIG. 9 is a top view of the locator-retainer of FIGS. 3 and 4.
Figure 13:
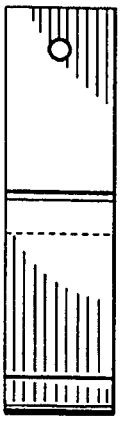
FIG. 13 is a front side view of an alternative intermediate siding locator-retainer made of formed or bent sheet material.
Figure 14:
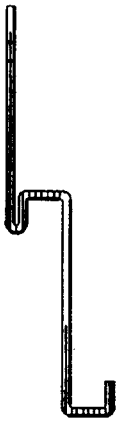
FIG. 14 is a left side view of the alternative intermediate siding locator-retainer made of formed or bent sheet material according to FIG. 13.
Figure 10:
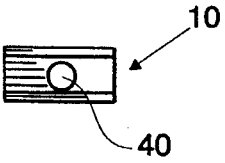
FIG. 10 is a top view of the locator-retainer of FIGS. 5 and 6.
Figure 15:
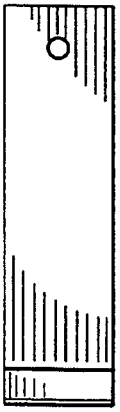
FIG. 15 is a front side view of an alternative lower siding locator-retainer made of formed or bent sheet material.
Figure 16:
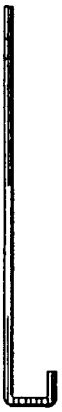
FIG. 16 is a left side view of the alternative lower siding locator-retainer made of formed or bent sheet material according to FIG. 15.

If desired, the siding clips can be provided with at least one weep hole 40 in the bottom of each upwardly opening recess 12 of lower retainer 10 and recess 31 of intermediate retainer 16, as shown in FIGS. 10 and 9, respectively.

The siding clips can be made of molded or extruded plastic, or extruded or sheet-formed metal, such as aluminum, steel, galvanized steel, brass, tin plate, and the like. FIGS. 11 through 16 show how upper, intermediate, and lower siding clips would be formed from sheet metal, to achieve substantially equivalent locator-retainer members shown in corresponding FIGS. 1 through 6.

The siding clips can be painted, or, if plastic, can be either clear or have an integral color. Plastics should include an ultra-violet absorber. If the clips are painted, the paint should include an ultra-violet absorber in its formulation. A suitable ultra-violet absorber is marketed under the trade name TINUVIN by Ciba-Geigy. Corporation, Dyestuff and Chemicals Division, Greensboro, N.C.

Figure 17:
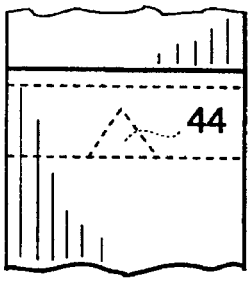
FIG. 17 is a partial front view of another alternative intermediate siding locator-retainer incorporating a gripper therein.
Figure 18:
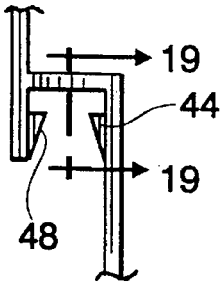
FIG. 18 is a partial left side view of the alternative intermediate siding locator-retainer of FIG. 17.
Figure 19:
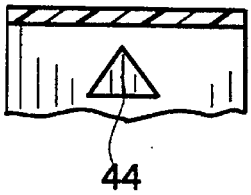
FIG. 19 is a sectional view of the alternative intermediate siding locator-retainer taken along line 19—19 of FIG. 18.
Figure 20:
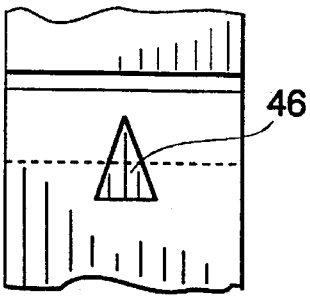
FIG. 20 is a partial front view of another alternative sheet metal intermediate siding locator-retainer incorporating a gripper therein.
Figure 21:
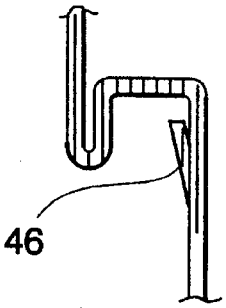
FIG. 21 is a left side view of the alternative intermediate siding locator-retainer of FIG. 20.

As shown in FIGS. 17 through 19 the downwardly opening recess can be provided with a detent, barb, or other gripper 44 on its sides for tight holding to the top of a siding member on which the locator-retainer is installed. A single gripper 46 may be provided, as shown in FIGS. 20 and 21, or a pair of opposed grippers 44, 48 may be provided as shown in FIGS. 17 through 19. The gripper can be of any desired shape, but it is preferable that it aid in installation of the locator-retainer by being angled as shown. In a metal locator-retainer, the gripper member may be formed by punching an inverted V-shape into the locator-retainer at the proper location, as shown, so that the point is bent inward.

SUMMARY OF THE ACHIEVEMENT OF THE OBJECTS OF THE INVENTION

From the foregoing, it is readily apparent that I have invented an improved method and apparatus for improved means for hanging a floating wall of siding material on a building such as a house, faster and more economically than heretofore has been possible, by installing siding hangers for attaching siding to studs without the necessity of nailing to or through siding or adjacent pieces of siding.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. A wall structure comprising a series of spaced upright studs; a multiplicity of "J" shaped lower siding locator-retainer members fastened to said studs;

an elongated siding member having upper and lower edges, the lower edge of said siding member being positioned in said "J" retainers;

a series of intermediate siding locator-retainer members for engaging the upper edge of said first siding member, fastened to said studs and having means for locating and retaining a next higher siding member with its lower edge in parallel alignment with the lower edge of said first siding member and;

a series of upper locator-retainer members attached to said studs and engaging the upper edge of said upper siding member;

wherein each said upper siding locator-retainer member has an elongated vertical component attachable to a stud, a generally horizontal component extending outwardly from the bottom of and substantially normal to said vertical component, and a flange extending downwardly from the end of said horizontal component and forming a downwardly opening recess in said upper siding locator-retainer member.

2. A wall structure according to claim 1, wherein said lower siding locator-retainer member has an elongated vertical component attachable to a stud, a generally horizontal component extending outwardly from the bottom of and substantially normal to said vertical component, and a flange extending upwardly from the end or said horizontal component and forming and upwardly opening recess in said lower siding locator-retainer member.

3. A wall structure according to claim 1, wherein said intermediate siding locator-retainer member has an elongated vertical component attachable to a stud and having a lower end, a generally horizontal component extending outwardly from above the lower end of and substantially normal to said vertical component for a distance of about the thickness of the upper edge of said siding member, a second vertical component extending downwardly and forming with said vertical component a downwardly opening recess generally centrally in said intermediate siding locator-retainer member, a second generally horizontal component extending outwardly from the bottom of and substantially normal to said second vertical component, and a flange extending upwardly from the end of said second horizontal component and forming and upwardly opening recess in said intermediate siding locator-retainer member.

4. A wall structure according to claim 1, further comprising an aperture in the upper portion of each of said siding locator-retainer members.

5. A wall structure according to claim 1, further comprising a weep hole in the bottom of said lower and intermediate siding locator-retainer members.

6. A wall structure according to claim 1, wherein said siding locator-retainer members are made from a material selected from the group consisting of plastics and metals.

7. A wall structure according to claim 6, wherein said siding locator-retainer members are made from aluminum.

8. A wall structure according to claim 6, wherein said plastic material is selected from the group consisting of polypropylene (PP), polyethylene (PE), ultra high molecular weight polyethylene (UHMW PE), ethylene chlorotrifluoroethylene (ECTFE), ethylene tetrafluoroethylene (ETFE), polyvinylidene fluoride (PVDF), chlorotrifluoroethylene (CTFE), fluorinated ethylene propylene (FEP), perfluoroalkoxy (PFA), acrylonitrile-butadiene-styrene (ABS), chlorinated polyvinylchloride (CPVC), fiberglass reinforced polypropylene, fiberglass reinforced vinyl ester, fiberglass reinforced epoxy, polyphenylene sulfide (PPS), polyphthalamide (PPA), fiberglass reinforced polyvinylchloride, and polysulfone.

9. A wall structure according to claim 8, further comprising an ultra-violet absorber incorporated into said plastic.

10. A wall structure according to claim 6, wherein said siding locator-retainer members are extruded.

11. A wall structure according to claim 6, wherein said siding locator-retainer members are molded.

12. A wall structure according to claim 6, wherein said siding locator-retainer members are formed from metal sheet.

13. A wall structure according to claim 6, further comprising a painted coating on each of said locator-retainer members.

* * * * *